US005313869A

United States Patent [19]

Lee

[11] Patent Number: 5,313,869

[45] Date of Patent: May 24, 1994

[54] SHELL RELOADER

[75] Inventor: Richard J. Lee, Hartford, Wis.

[73] Assignee: Lee Precision, Inc., Hartford, Wis.

[21] Appl. No.: 988,814

[22] Filed: Dec. 10, 1992

[51] Int. Cl.[5] ..... F42B 33/02

[52] U.S. Cl. ..... 86/25; 86/27; 86/32; 86/44; 86/46

[58] Field of Search ..... 86/25, 27, 28, 32, 44, 86/46

[56] References Cited

U.S. PATENT DOCUMENTS

| | | | |
|---|---|---|---|
| 4,343,222 | 8/1982 | Dillon | 86/27 |
| 4,393,744 | 7/1983 | Lee | 86/25 |
| 4,515,063 | 5/1985 | Lee | 86/27 |
| 4,522,102 | 6/1985 | Pickens | 86/27 |
| 4,766,798 | 8/1988 | David et al. | 86/27 |
| 4,817,491 | 4/1989 | Fenton | 86/19 |
| 5,054,362 | 10/1991 | Bachhuber | 86/27 |

*Primary Examiner*—J. Woodrow Eldred
*Attorney, Agent, or Firm*—Ryan, Kees & Hohenfeldt

[57] ABSTRACT

A shell plate for being indexed in angular steps is on a carrier which is, in turn, mounted to the upper end of the reloader ram. Indexer rod engageable elements such as cylindrical equiangularly spaced apart pins project downwardly from the bottom of the shell plate. An indexer rod is carried in the shell plate carrier. When the ram is driven to nearly its lowermost position, the manual operating lever is near the end of its swing at which time it abuts the indexer rod for the latter to engage one of the pins to rotate the shell plate. The indexer rod is retracted and reset by having it slide down a guide track from the uppermost position of the ram and the guide track is angulated in part to be engaged by the rod and retracted. The reloader is distinguished by indexing the shell plate only when the ram is within a few millimeters of its lowermost limit. The reloader also features an improved device for inserting primers in shells and an inserter for inserting shells into the indexable shell plate for being reloaded. The shell inserter is especially designed for working with a reloader wherein the shell plate indexes when the ram is very near its lower limit the design provides for inserting the shell in the shell plate when the ram has begun to move upward again at which time substantial force is available from the manual operating lever.

15 Claims, 8 Drawing Sheets

SHELL RELOADER

BACKGROUND OF THE INVENTION

The invention disclosed herein pertains to a fully progressive ammunition shell reloading machine. Various models of progressive reloading machines are known. They are characterized generally by performing several shell reloading operations in sequence and then discharging the shell after the final step which usually involves pressing and securing the bullet in the shell. The usual sequence of operations is to first press the shell into a tool at a first station which expels the spent primer cap and may also size the shell. The next step is to insert a new primer followed by the step of filling the shell with a predetermined amount of powder. A bullet is inserted in the shell at the next station and it may be crimped before the reloaded shell is discharged from the machine. The sequence of operations performed on the shells is done while the shells are held in shellholder pockets in a rotatable shell plate for being indexed angularly from one tool station to another until all reloading operations are completed. The shell plate is usually indexed through one angular step when the vertically reciprocal ram on which the shell plate is carried is moving downwardly. A lever is manually operated to effectuate the sequence of reloading operations simultaneously on all shells in the index plate so that when one shell, for example, is having its spent primer cap removed, the shell that is advanced rotationally one angular step ahead is having a new primer inserted in it and so on. When an individual shell has undergone all of the reloading steps, it is discharged from the shell plate.

An existing progressive shell reloading machine is described in U.S. Pat. No. 4,343,222, for example.

The term "shell" is used herein as synonymous with "cartridge or case" for pistol and rifle ammunition since the illustrated embodiment of the reloader is dedicated to processing metal cases rather than shotgun shells.

SUMMARY OF THE INVENTION

The new shell reloader described herein is distinguished by indexing the shell plate on the ram rotationally through an angular step not earlier than when the ram is very close to its downward limit. This provides the maximum distance between the shell plate and the reloading tools so as to allow not only reloading of relatively short shell bodies such as are used in pistols but also very long shell bodies such as are used in rifles.

The new reloader is further distinguished by the combination of a shell plate and a shell inserter that allows insertion of an empty shell in the shell plate shortly before the ram has reached its lower limit. Because the shell plate is not indexed rotationally through one angular step until the shell plate is almost as low as it can go with the ram, long rifle shells can be handled without the problem of having the upper tips of the shells encounter any obstruction during indexing.

The reloader also has a unique feature for feeding live primers to a chamber from which they are pressed into a shell that is being held in the shell plate. Live primers are fed consecutively into the chamber through a trough by gravity. The new primer feeder features a swingable arm that positions the primer onto a post. The arm is always pushed into the primer readiness position by a wedge rod mounted to the top of the press so the rod swings the arm when the ram and shell plate thereon are near the top of the stroke. An o-ring at the arm pivot point provides friction to maintain the arm position. The arm is reset or swung back to accept another primer by the force of a shell that strikes the arm when the shell plate is indexing. Thus, if no shell is present no primer is fed out.

The priming operation in the new reloader is carried on when the ram and the shell to be primed on the shell plate is moving upwardly rather than during the downstroke as is done on most existing reloader presses. By priming on the upstroke of the ram, angular indexing of the shell plate at the very end of the downstroke of the ram is made possible.

A most important feature of the new press is an indexer that is comprised of only two moving parts, namely, a simple actuator rod or indexer and its flipper. The rod is driven directly by the manual operating lever just before the lever reaches the end of its upward travel and the ram is just short of its lower limit to engage the shell plate and index it one angular step.

How the foregoing and other features of the new reloader are implemented, will appear in the ensuing more detailed description of a preferred embodiment of the invention which will now be set forth in reference to the drawings.

DESCRIPTION OF A PREFERRED EMBODIMENT

Figure 1:
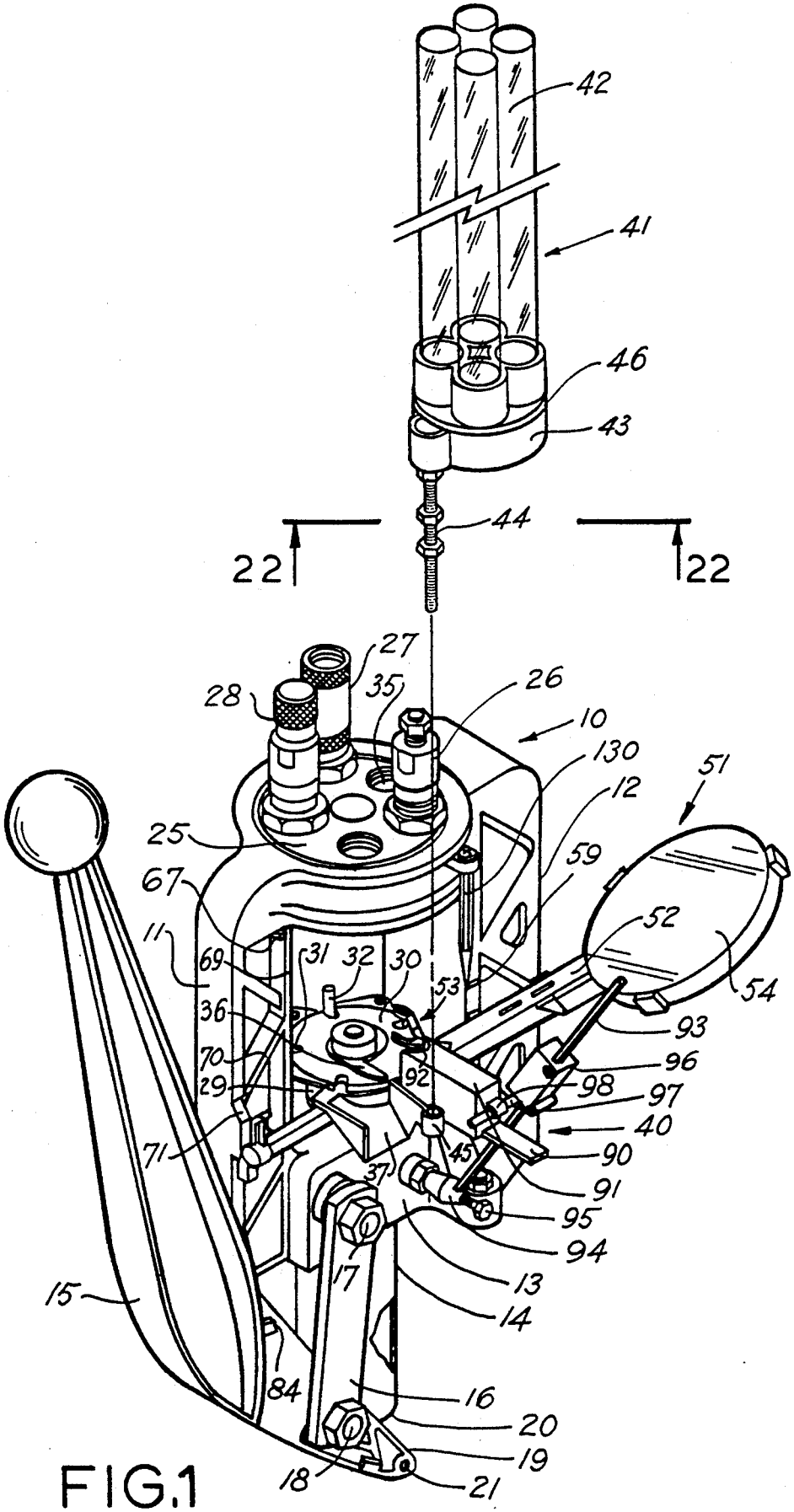
FIG. 1 is a perspective view of the new reloader as viewed from its right side where right and left are defined relative to the operating handle which is considered to be at the front of the reloader intermediate to the right and left side.

Attention is invited to the right side perspective view of the reloader in FIG. 1 for having the various parts of the reloader identified in general terms. The reloader comprises a generally D-shaped frame 10 having a front leg 11 and a rear leg 12. A rigid base 13 spans between legs 11 and 12 and joins them integrally. A cylindrical hollow ram 14 is adapted for sliding through base member 13 upwardly and downwardly under the influence of a manually operated lever 15. On each side of the frame there are links such as the ones marked 16 in FIG. 1 and 22 in FIG. 2. Corresponding ends of links 16 and 22 are swingable on a shaft 17 which is fixed to the reloader frame 10. The other ends of links 16 and 22 are pivotable or swingable on a shaft 18 that is mounted to an arm portion 19 of reloader operating lever 15. The lower end 19 of manual operating lever 15 is pivotally connected to the lower end 20 of ram 14 by means of a pin 21 in the remote end of lever 15 as can be seen particularly well in FIG. 16. It will be evident that when operating lever 15 in FIG. 1 is swung downwardly or counterclockwise from its FIGS. 1 or 2 position, the lower end 19 of the lever swings upwardly and causes hollow ram 14 to move upwardly. Restoring the operating lever to its FIG. 1 position causes the ram to descend to its lower limit as it is depicted in FIG. 1. The ram operating lever and the linkage is similar to that which is described in U.S. Pat. No. 4,343,222 with some stops added to the lever for purposes of the invention.

Figure 2:
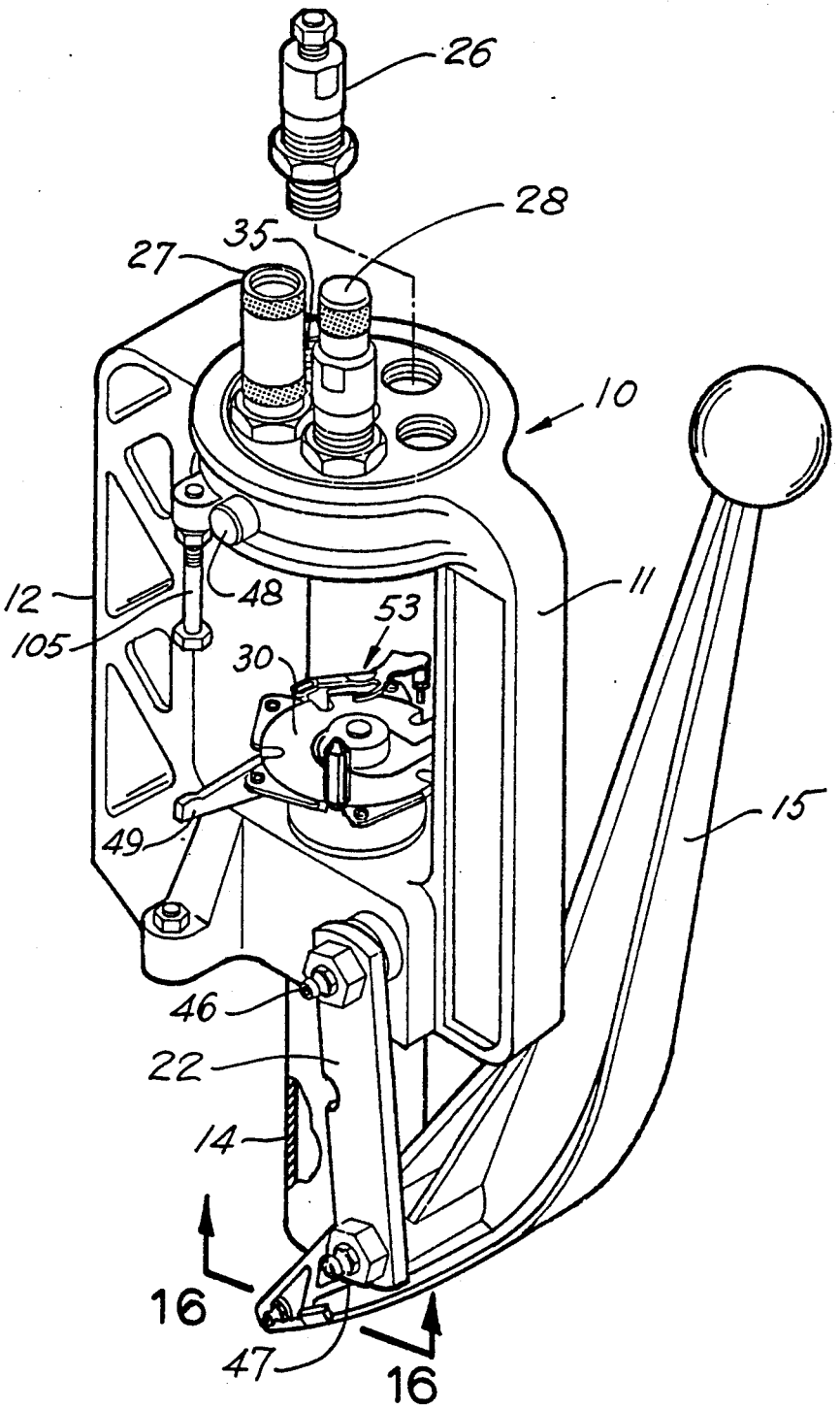
FIG. 2 is an elevational perspective view of the reloader as viewed from its left side.

In the upper part of frame 10 there is tool carrier disk or turret 25. For the reloading operations that are contemplated with the present set up of the reloader, three reloading tools 26, 27 and 28, commonly called dies, are screwed into turret 25. The turret is rotatable to set the tools 26–28 in a particular alignment after which the turret is locked against rotation by a set screw having knurled knob 48 as is depicted in FIG. 2.

Figure 14:
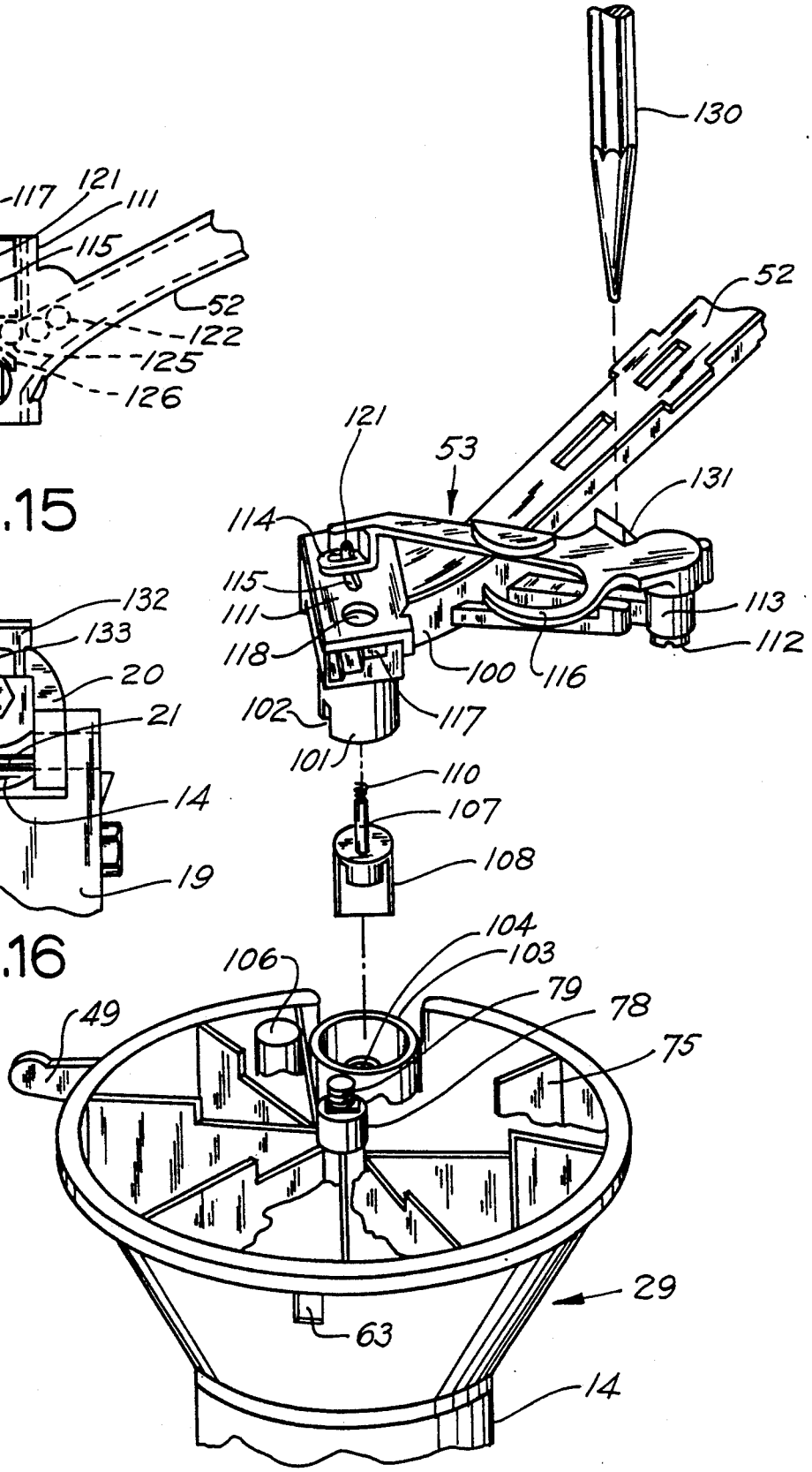
FIG. 14 is an exploded view of the primer inserter assembly in conjunction with a conical shell plate carrier on which the inserter mounts.

Referring to FIG. 1 again, the upper end of ram 14 has a conical carrier 29 mounted to it. The carrier is not fully visible in FIG. 1 but, as shown in FIG. 14, it is basically a hollow cone that has a wide top mouth and tapers down to a diameter comparable to the diameter of the hollow ram 14 on which the carrier is mounted. The carrier will be discussed in more detail later. Mounted on top of the carrier is a rotatable shell plate 30 that is indexable in equiangular steps. The shell plate has a plurality of angularly spaced apart shell holder pockets 31. A short shell 32 for use in a pistol is presently inserted in one of the pockets of shell plate 30. An important feature of the disclosed reloader is that it can handle pistol and long rifle shells. The pockets 31 are angularly spaced apart in correspondence with the angular spacing of the tools 26–28. The tools themselves are conventional insofar as their operations are concerned. Thus, when the ram is moved to its upper limit, shells which are held in the pocket of the shell plate 30 are acted upon by the tools 26–28 simultaneously although each tool performs a different operation. Thus, four different reloading steps are performed at the same time if the angularly spaced apart pockets are occupied by shells. Die or tool 26, in this example, is adapted for expelling the spent primer from an empty shell when a shell on the shell plate 30 is raised under the influence of the ram 14 to cause the shell to enter the bore of tool 26. The tool 26 also sizes the outside of the shell at the same time that it expels the primer. This tool is conventional and is available commercially from several sources.

The threaded hole marked 35 in turret 25 contains no tool although a reloading operation is performed at this station. The operation is the insertion of a new live primer into the shell after it has been de-primed and sized by tool 26. The operation of inserting a new primer with the new primer inserter will be discussed in more detail later.

After every operation that is performed on the shells by a tool, the shells are lowered with the shell plate on the ram to a place where the ram is very close to its downward limit. The shell plate on the ram is then indexed through one angular step and elevated again to be acted upon by the next tools in the sequence. In this example, the tool that is one angular step from the threaded hole 35 is tool 27 which is adapted for having a known type of powder inserter, not shown, mounted on it. Tool 27 is essentially a tubular member that guides the powder into the shell. After the ram is recycled and the shell plate is indexed again, the shell under consideration is driven into tool 28. At a time when the shell has received powder the shell plate is indexed at its lower limit and a bullet, not shown, is inserted in the shell. Then when the ram is driven upwardly again, the bullet enters the bullet-seating die 28 which squeezes the shell onto the bullet and completes the shell reloading sequence. After the bullet is set, the ram 14 descends to its lower limit and indexing of the shell plate one angular step plate occurs again. Upon this event, the shell strikes a curved fixed ejector 36 which causes the shell to be deflected out of pocket 31 and into a chute 37 from which the reloaded shell drops into a container, not shown.

The reloader also features an empty shell inserter, generally designated by the numeral 40, which is adapted for inserting empty spent shells into pockets 31 of the angularly indexable shell plate 30. An empty shell is inserted for every index step of the shell plate and a reloaded shell is ejected for every index step. The shell inserter will be discussed in greater detail later. The empty shells which are inserted by inserter 40 are withdrawn from a shell holder that is generally designated by the numeral 41. Shell holder 41 includes four transparent tubes for stacking shells, such as the tube marked 42. The shell holder has a base 43 from which a mounting stud 44 projects. Mounting stud 44 fits into a hole in a socket 45 and is fixed at the proper height with the nuts on the studs shown. The shell holder base has two parts, part 43 which is already been mentioned and another part 46 which is indexable or rotatable relative to part 43. Part 43 has a hole 38, not visible in FIG. 1 but visible in FIG. 22, through which shells drop for being transferred to the shell plate 30. The shell feed or insertion operation will be described in greater detail in conjunction with the description of the shell inserter 40 which will be presented later.

Refer now to FIG. 2 which is a perspective view of the reloader taken from its left side. The link 22 in FIG. 2 is comparable to the parallel link 16 which was previously mentioned. In FIG. 2 the shafts 17 and 18, not visible, on which the link 22 pivots have grease fittings 46 and 47 installed in them for lubricating the pivots. In FIG. 2, the knurled knob 48 which turns a screw, not visible, that locks the turret 25 in a position such that the tools 26–28 are set in coincidence with the angular separation of the shell holder pockets 31 in the periphery of the shell plate 30. Also visible in FIG. 2 is a lever 49 which is caused to rock when it strikes an adjustable stop bolt 105 when the ram is elevated to force shells in the pockets of the shell plate into the tools 26, 27 and 28 for performing the previously discussed reloading operations. Lever 79 participates in driving the new primer into the case at a time when the ram is elevated and the case is aligned with the threaded open hole 35 in the turret. Insertion of the new primer will be discussed in greater detail later.

Going back to FIG. 1, there is shown a circular hollow chamber that is generally designated by the numeral 51 and is used for storing live primers. The primers feed down a trough 52 from a container 53 to a place, not visible in FIG. 1, where they are positioned for being pushed into the head end of the shell in a pocket of the shell plate. A part of the primer insertion mechanism also appears in FIG. 2, and includes an arm 53 that participates in the primer insertion operation as will be explained in greater detail later.

Attention is now invited to FIGS. 3–10 for a more detailed description of the structure of the shell plate, its indexing mechanism, and the features on the frame of the reloader which participate in effecting indexing of the shell plate.

Figure 6:
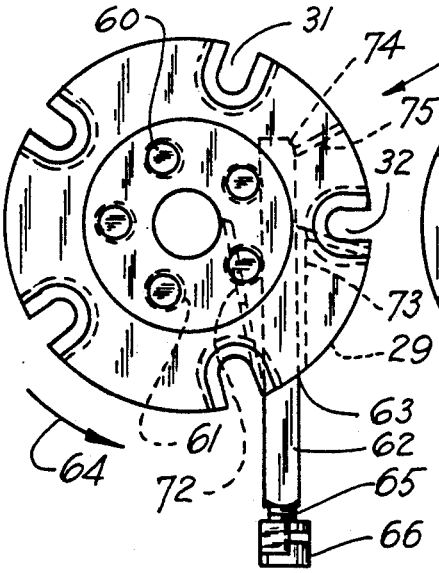
FIGS. 6, 7 and 8 are plan views of the five shell holder shell plate showing the indexer rod member in various positions which it attains in the process of indexing the shell plate rotationally through an angular step.

FIG. 6 is a plan view of the shell plate 30 that reveals it has, in this embodiment, five shell holder pockets 31 in which shells are consecutively inserted in preparation for a reloading cycle. Other models, not shown, may have a lesser number of pockets. For instance, in the reloader embodiment being discussed, the shell to be reloaded is inserted in the pocket 32 before the first reloading operation is performed on the shell. FIG. 6 shows the shell plate to have five shallow circular recesses 60 which are involved in an operation other than indexing of the shell plate 30 to angular steps. There is a dashed line circle marked 61 surrounding each of the shallow recesses 60. The dashed line circle 61 represents an indexing element comprised of a cylindrical pin which extends downwardly from the bottom of the shell plate. The five pins 61 on the shell plate are visible in FIG. 10. The downwardly extending cylindrical pins 61 are characterized as indexer engageable elements since they participate in rotating the shell plate to one angular step each time the ram 14 is caused to descend under the influence of operating lever 15 to very near the lower limit of the ram's downward movement FIG. 6 shows an indexer rod 62 which is slidable through an opening 63 in the conical shell plate carrier which was identified by the numeral 29 in FIG. 1. The indexer rod 62 is shown in tangential contact with two of the cylindrical lugs 61 at the present time. In FIG. 6 an angular indexing step of the shell plate 30 has just been completed. Indexer rod 62 is automatically advanced to the position in which it is shown in FIG. 6 in response to the manual operating lever 15 being moved to its most clockwise position as depicted in FIG. 1. It is when the handle 15 is at its uppermost position and the ram is almost at its lowermost position that indexer rod 62 is advanced radially inwardly to engage an indexer element 61 and rotate the shell plate 30. One angular step constitutes the angle between two circumferentially spaced apart shell holder pockets 32. This angle corresponds to the angle between the tools 26, 27 and 28 on the tool carrier turret 25. One end of indexer rod 62 has a thread 65 and what is called a flipper 66 is screwed onto the thread. The manner in which the parts are related in FIG. 6 is the manner in which they are related when the ram is in its lowermost position and the indexer plate has just been rotated and this position is maintained until the ram drives the shell plate to its uppermost position. However, as will be explained, when the shell plate reaches its uppermost position and before lowering of it starts, the flipper 66 is angulated slightly to rock the indexer 62 and assure that it is properly positioned for descending along a guide path that ultimately ends with the indexer rod 62 retracted so the rod can initiate another angular rotational indexing step of the shell plate 30.

Figure 3:
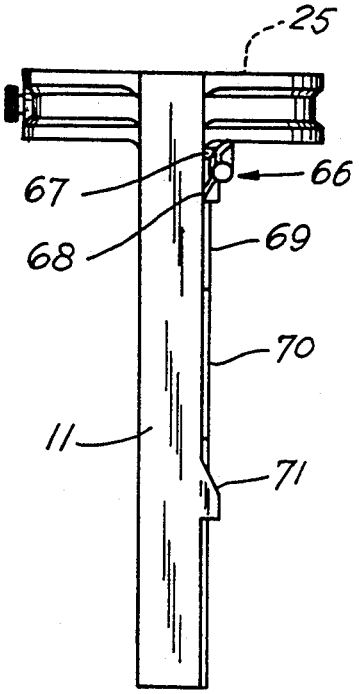
FIGS. 3, 4 and 5 are elevational views of the front leg or side of the reloader frame for exhibiting an indexer member and the cam guide track that retracts the indexer during lowering of the ram.
Figure 4:
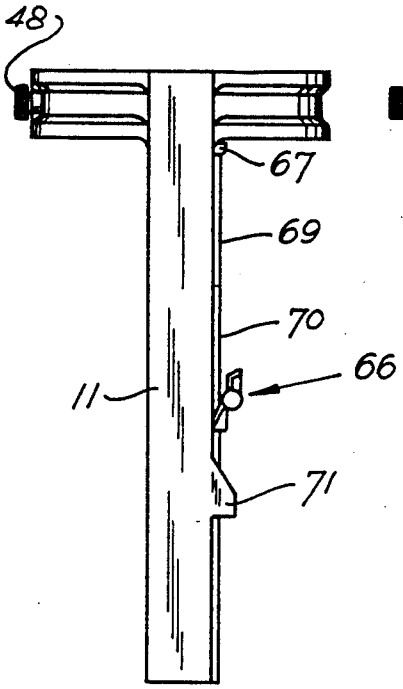
Figure 5:
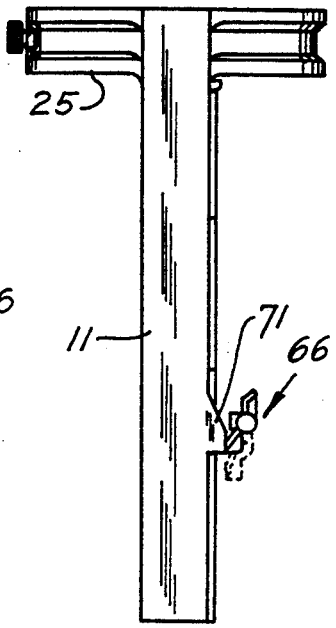
Figure 7:
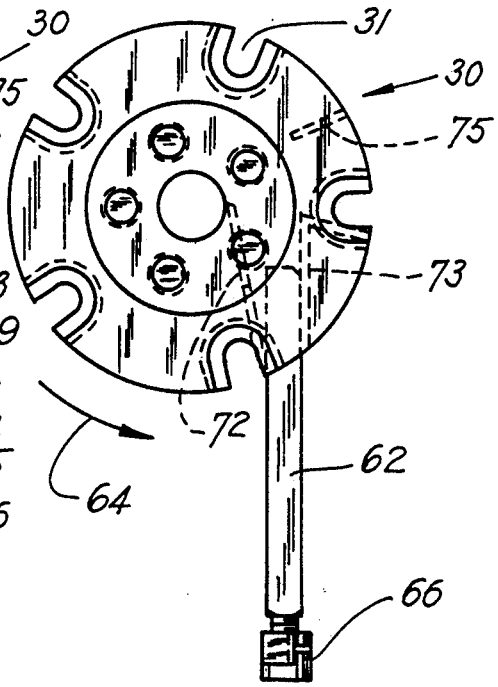
Figure 8:
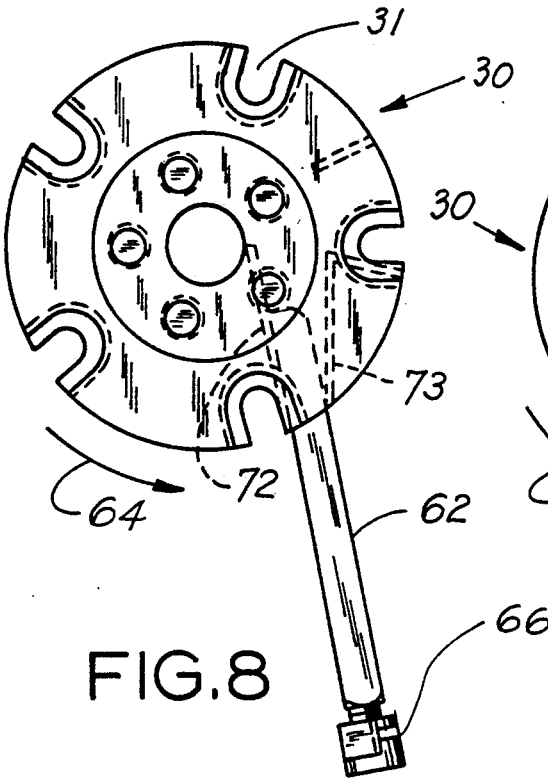

The flipper 66 is shown in FIG. 3, adjacent FIG. 6, positioned as it would be at the moment the shell plate 30 is elevated sufficiently for shells on the plate to be operated on by the tools 26, 27 or 28. As shown in FIG. 3, there is a projection 67 on the front leg 11 of the reloader frame. The flipper 66, which may be otherwise considered to be a follower, has its lower end 68 urged by projection 67 against a track section 69 which is formed on frame leg 11. This track section 69 is also shown in FIG. 1. As the shell plate and flipper follower 68 descend with the ram, the flipper follower 66 arrives on another track section 70 as in FIG. 4 which looks like an angulated reinforcement rib in FIG. 1, but it serves the dual purpose of serving as a track section as well. Angulated track 70 causes the indexer to retract to clear shell plate 30 for being indexed. Note that track sections 69 and 70, when viewed in profile as in FIG. 3, extend forwardly of frame leg 11. FIG. 7 shows indexer rod 62 retracted. It should be understood that the indexer rod 62 slides in the conical shell plate carrier 29 under the shell plate so the shell plate can rotate through an angular step independently of the carrier. It is not fully retracted, however, in FIG. 7 since the flipper 66 and the flipper track follower element 68 is not at its lowermost descent as yet. The flipper ultimately reaches and rides on a beveled projection 71 as in FIG. 5. This projection takes the flipper off of the guides and swings the indexer rod at an angle as indicated in FIG. 8. Note that the indexer rod extends through the opening 63 in the conical shell plate carrier 29 on which the shell plate 30 is mounted for counterclockwise rotation. Within the shell plate carrier there are guide webs 72 and 73 between which the indexer rod 62 lies and can swing. Because projection 71 has swung indexer rod 62 in FIG. 8 coincident with the ram arriving at about 3 to 6 mm before its downward moving limit the indexer rod is now engaged with one of the lugs 61. The ram 14 is slightly above its lowermost limit and operating lever 15 is moving in a direction for forcing the ram downwardly. Thus, when the operating lever 15, as shown in FIG. 1, is near the end of its clockwise swing, it butts against the end of indexer rod 26 on which the flipper and flipper follower assembly 66 is mounted and drives the indexer rod 26 radially inwardly of the shell plate carrier 29 so that the end of indexer rod 62 is able to exert a rotational moment on indexing element 61. FIG. 8 shows the indexer rod 62 in readiness for being pushed in against an index element 61. When the indexer rod 62 is driven radially inwardly as far as it will go by operating lever 15, the rod takes the position again exhibited in FIG. 6 where it lays up against two of the indexing elements 61 to positively prevent the index plate from rotating. Now, the ram can be driven upwardly by operation of manual operating lever 15 to introduce the shells, not shown, in the various pockets 31 of shell plate 30 into the respective tools on turret 25 in frame 10

Note is FIG. 6 in particular that the leading end of indexer rod 62 has a bevel 74 on one corner. The conical shell plate carrier 29 underneath the shell plate has another web 75 to hold the shell plate solidly against any circumferential vibration when the ram is ascending. The wedging is not absolutely necessary, however.

Figure 9:
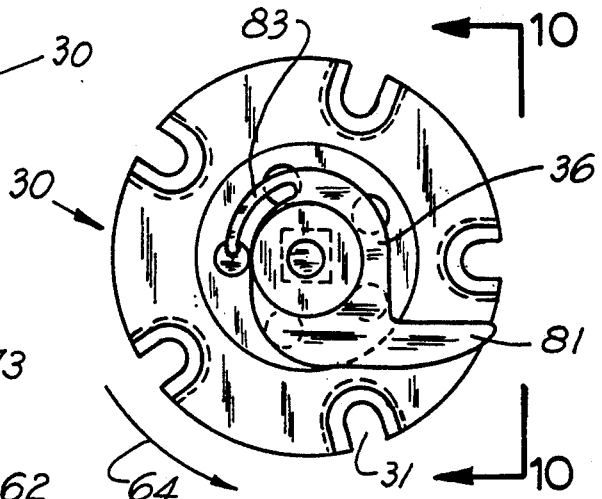
FIG. 9 is a plan view of the shell plate with an ejector member assembled thereto, said member causing a finished reloaded shell to be ejected from the shell plate of the reloader.
Figure 10:
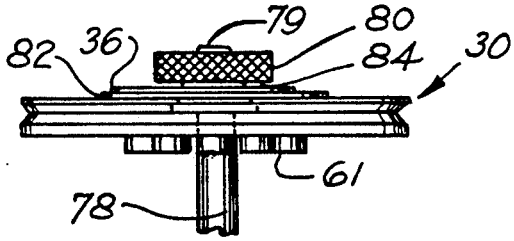
FIG. 10 is a side elevational view of the shell plate when isolated from its carrier on the ram as viewed in the direction of the arrows 10—10 in FIG. 9.

A profile of the shell plate 30 isolated from the shell plate carrier 29 is shown in FIG. 10. A stud 78, shown fragmentarily, extends upwardly from shell plate carrier 29. Stud 78 is fixed against rotation. Its one end 79 has a thread on it. A knurled clamping nut 80 is turned onto the thread. The thin metal shell ejector 36 is held down by nut 80. As shown in FIG. 9, the ejector 36 has an arm 81 which is mounted on a stud in a manner that blocks the ejector against rotation. When a shell has had its bullet inserted so that it is finished for discharge from the reloader, that shell will be in the pocket which has the referenced numeral 31 applied to it in FIG. 9. When the shell plate is indexed again through an angular step in a rotational direction indicated by the arrow 64, the completely reloaded shell strikes the curved arm 81 of ejector 36 and the arm forces the shell out of the indexer plate and down into the chute 37 which was previously mentioned in connection with discussing FIG. 1. The ejector 36 is mounted, as shown in FIG. 10, on a thin circular riser 82. As is evident in FIG. 9, the ejector 36 has at one end a tongue portion 83 that is bent downwardly so that it extends into previously mentioned shallow recess 60. Since the ejector 36 overlays the thin riser 82 formed on top of the shell plate 30 and the springy end 83 of the ejector bends downwardly a force is developed which assists in keeping the shell plate forced downwardly into the underlying shell plate carrier 29. There is, under nut 80, a small gap in which there is an o-ring 84 that serves as a friction element which prevents lock nut 80 from loosening.

At this point it may be noted that manual operating lever 15 has a stop 84 projecting from it as shown at the lower end of the lever in FIG. 1. Stop 84 abuts against link 16 when the handle 15 is at its desired post indexing limit. This assures that indexer rod 62 can not be overdriven.

The mechanism 40 by which empty shells are inserted in shell plate 30 was briefly mentioned earlier in connection with discussing FIG. 1. This mechanism will now be described in greater detail. The mechanism was invented and is designed in a way that resolves the problem of inserting shell cases in the machine, according to the invention, wherein the shell plate 30 is not indexed until there is substantially no further opportunity for downward motion of the ram. The new mechanism for inserting shells obtained from shell storage device 41 into the shell plate 30 inserts the shells when the ram has started to move upwardly from its lower limit of travel.

Figure 22:
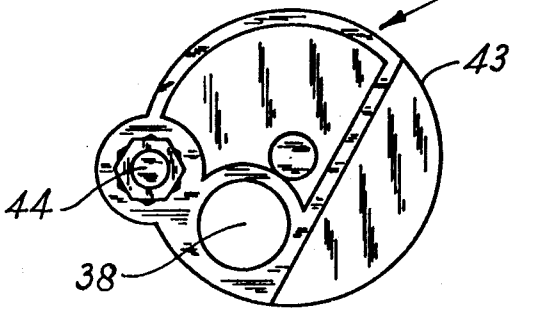
FIG. 22 is a bottom view of the shell storage device 41 that is depicted in FIG. 1.

Referring to FIG. 1 and 17–21, the empty shell inserter comprises a slider guide 90 mounted to the ram 14 for going up and down with the ram. A shell inserter slider 91 is configured for sliding inwardly and outwardly on slide guide 90. The inner end of shell inserter slider 91 has a substantially semi-circular recess 92 that acts as a nest for a shell that is dropped onto slider guide 90. As previously mentioned, the shell storage device 41, shown above the loader in FIG. 1 mounts by way of stud 44, in the hole of the holder 45 that is integral with reloaded shell output chute 37 on the reloader. FIG. 22 shows a hole 74 in the bottom of base 43 of the shell storage device through which a shell from among the stack of shells in the storage tubes 42 can drop onto slider guide 90 and ahead of semicircular recess 92. The bottom of the base 43 of the shell storage device 41 is set at a little more than the height of the shells to be reloaded above the slider guide 90, so the shell inserter slider does not encounter any interference as it moves back and forth on the guide 90 and the shell is maintained on the guide. A guide shaft 93 is secured at an angle onto frame 10 by means of a post 94 which has a bolt 95 for clamping the shaft 93 and holding it at an angle with respect to vertical. There is a crank slider 96 which can slide up and down at an angle on guide shaft 93. A swingable crank 97 is pivotally connected to slider 96 and extends through an eye 98 on the shell slider 91.

Figure 17:
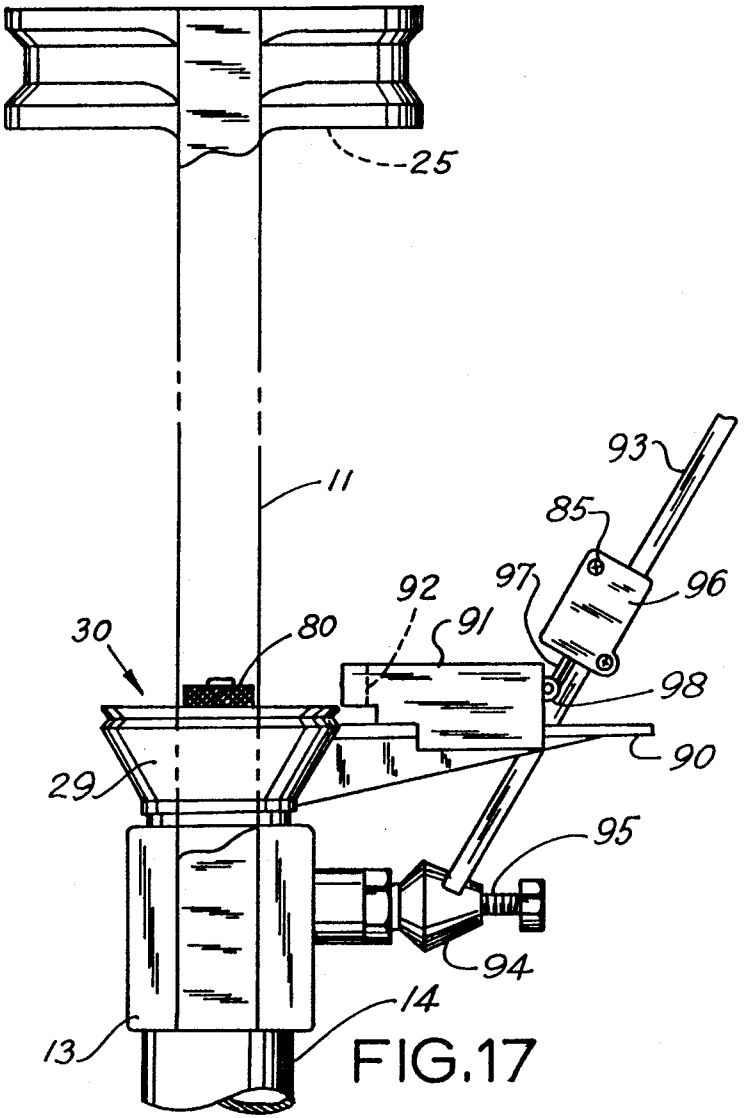
FIG. 17 shows one leg of the reloader frame and the ram movable on the frame in conjunction with the shell inserter mechanism wherein the ram is in its lowermost position and the shell inserter slider is proximate to the shell plate but not yet in a position for inserting a shell in the plate.

The unique operating mode of the shell inserter will now be described in detail in reference to FIGS. 17–21. FIG. 17 shows the ram 14 mounted for sliding in base portion 13 of the reloader frame. The conical shell plate carrier 29 is mounted to the ram and shell plate 30 is secured to the carrier. One side 11 of the reloader frame is shown and the circular element that contains the tool support 25 is also shown. In FIG. 17, ram 14 is its lowermost position. By operating manual lever 15, ram 14 will start to move upwardly. It is assumed that the shell plate 30 has been indexed already just before the ram reached its lowermost position. Shell inserter slider 91 is presently retracted a short distance from the shell plate 30 on horizontally extending slider guide 90. The slider guide is mounted to the conical shell plate carrier 29. Note in FIG. 17 that crank 97 which is pivotally connected to crank slider 96 at one end and to shell inserter slider 91 on the other is angulated downwardly in substantial parallelism with crank slider guide shaft 93. A dashed line marked 92 in FIG. 17 as it is in FIG. 1 is indicative of the depth of the semicircular recess 92 in which a shell that is to be admitted to a pocket in the shell plate 30 would reside if it were shown. Also in FIG. 17 there are two screws, one of which is marked 85, on the crank slider 96. These screws can be tightened to adjust the frictional drag of the crank slider on guide shaft 93.

Figure 18:
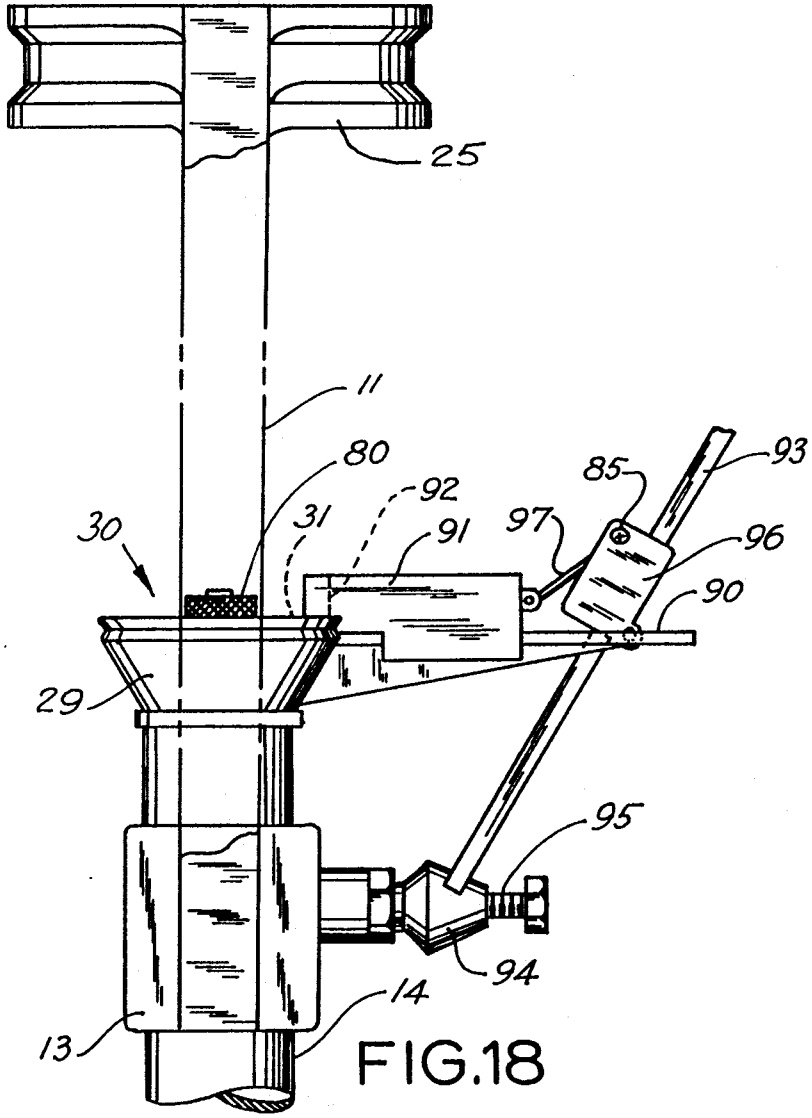
FIG. 18 is structurally similar to FIG. 17 but shows the ram moving upwardly and the shell inserter slider in the position wherein it inserts a shell into the shell plate.

In FIG. 18, ram 14 has departed from its lowermost position and is moving upwardly. At this time, a shell, not shown, in the semicircular groove 92 of the shell inserter slider 91 would be inserted into a pocket 31 of the shell plate 30. Because of the relatively small friction occurring between crank slider 96 and guide shaft 93, crank slider 96 dwells temporarily in the position in which it is shown in FIG. 18. The ram 14, however, is moving upwardly such that crank 97 must necessarily rotate clockwise so as to impel shell slider 91 into the shell inserting position in which it is presently shown in FIG. 18.

Figure 19:
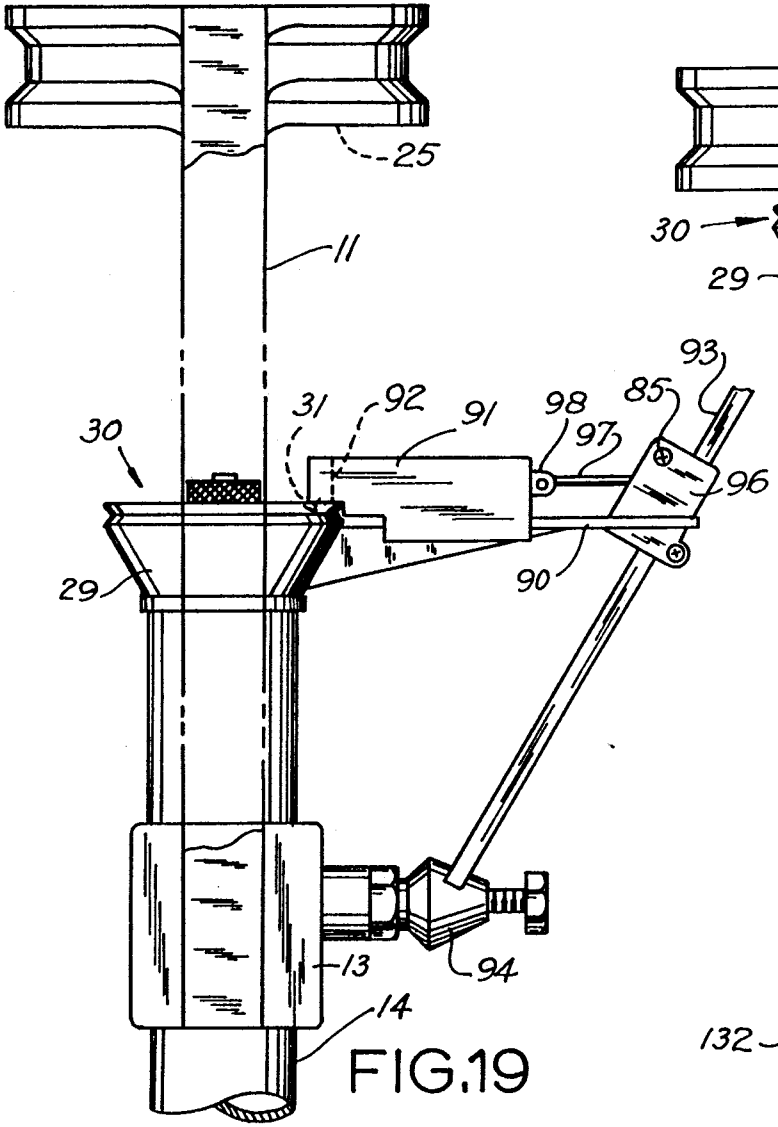
FIG. 19 shows the ram after it has moved upwardly from its position in FIG. 18 wherein retraction of the shell inserter slider from the shell plate begins.

In FIG. 19, ram 14 is on its way upwardly after having received an empty shell, not shown, in one of the shell holder pockets 31 of the shell plate 30. At this stage of operation, crank 97 is extended or horizontal. It became horizontal as a result of swinging in a clockwise direction due to crank slider 96 moving at an angle on guide shaft 93. In FIG. 19, shell inserter slider 91 has not begun to retract as yet along slider guide 90.

Figure 20:
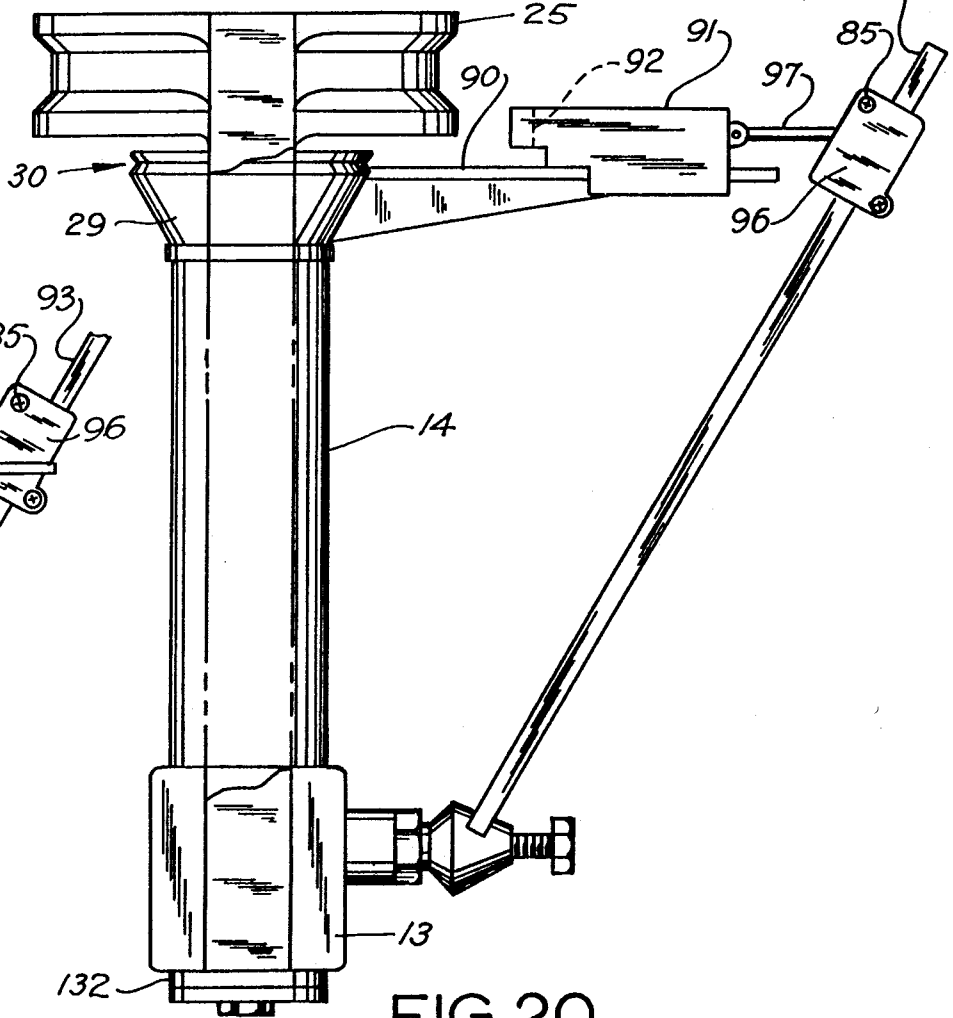
FIG. 20 shows the ram near its uppermost position and the shell inserter slider fully retracted to provide for depositing a shell in front of it.

In FIG. 20 ram 14 is near its uppermost position and shell plate 30 would have positioned some shells in alignment with the various tools 26–28. Since crank 97 has swung to its horizontal or most extended position in FIG. 19, as the crank slider 96 continues to move on the angulated crank slider guide shaft 93, shell inserter slider 91 is forced to retract sufficiently far for a shell to be deposited on horizontal inserter guide slide 90.

Figure 21:
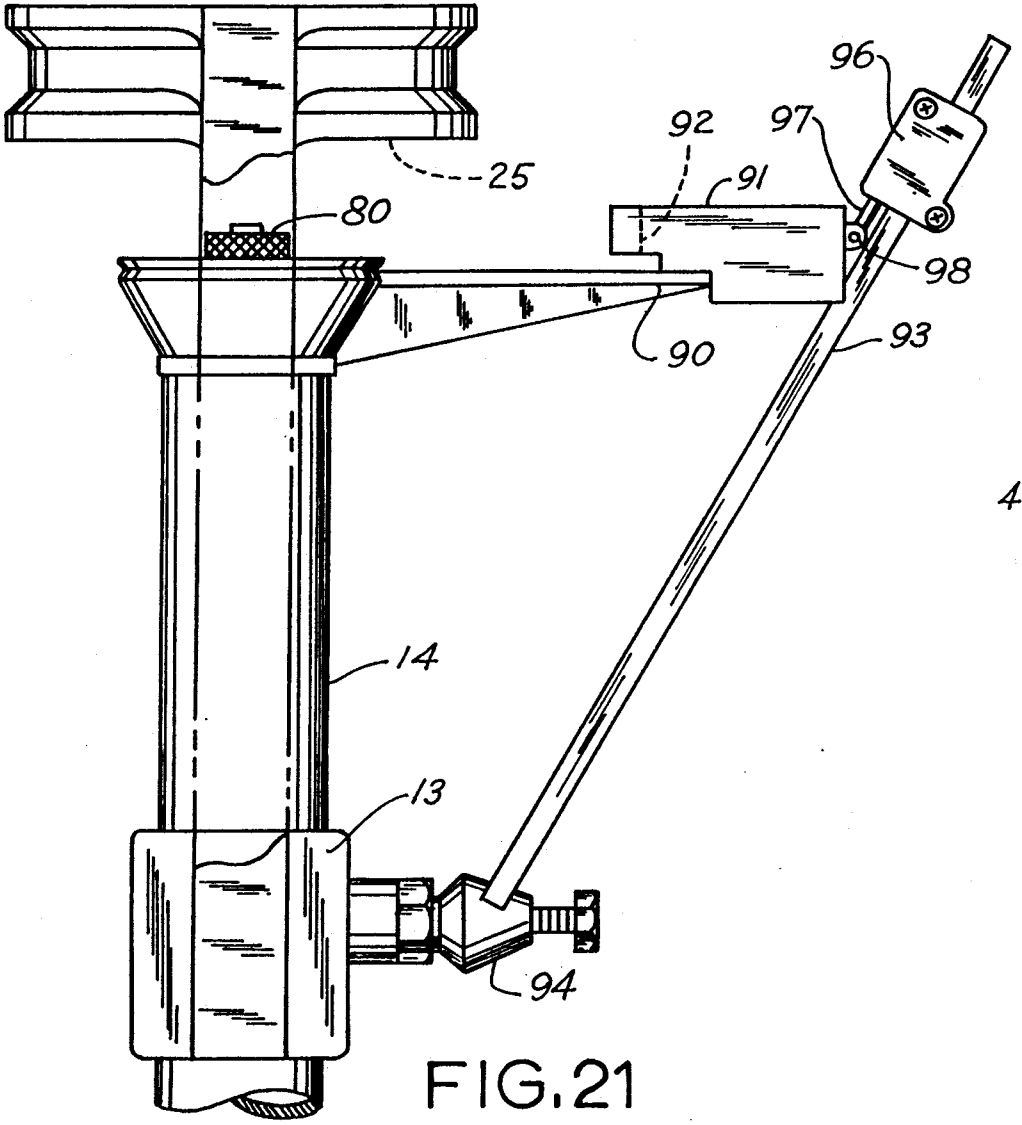
FIG. 21 shows the ram moving downwardly and the shell inserter slider still retracted.

In FIG. 21, ram 14 is descending from its uppermost position wherein the shells on the shell plate would have been acted upon by the tools 26–28 and would have had a new primer inserted for the spent primer was removed by tool 26. In FIG. 21, as the ram 14 begins its descent, shell inserter slider 91 which is simply resting on slider guide 90 retracts as shown in this figure and crank 97 is thereby caused to swing counterclockwise from its horizontal position in FIG. 20. Now the ram can continue descending and the shell inserter slider 91 will descend with it and crank slider 96 will slide downwardly on guide shaft 93. As the shell inserter slider 91 descends with the ram and the angulated crank slider, the angulation compels shell inserter slider 91 to move to its FIG. 17 position again coincident with the shell plate 30 being indexed again through one rotational angular step. The parts are then related to each other in FIG. 17 in readiness for participating in a shell insertion when the ram 14 has moved to a short distance above its lowermost position as previously discussed in reference to FIG. 18.

Figure 11:
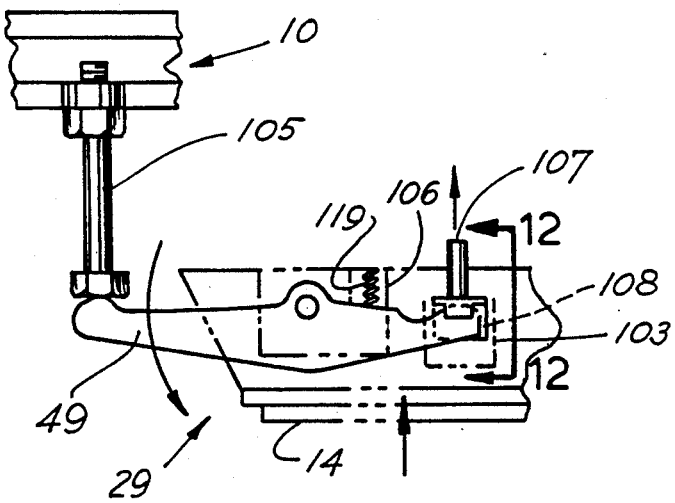
FIG. 11 is a side elevational view of a fragment of the shell plate carrier and a lever that is involved in driving a new live primer into a shell.

The mechanism for inserting live primers into the shells will now be described in more detail. As indicated earlier in connection with discussing FIG. 1, one of the threaded holes 35 in the tool holder turret 25 has no tool screwed into it in the described set up. It is when a shell on the shell plate is aligned with hole 35 that a primer is inserted in the shell. Hole 35 may, however, have a die in it for some set ups. For example a die or tool, not shown, could be one that expands the mouth of the shell or case. It has been previously mentioned in reference to FIG. 1 that the primers are held in a cylindrical chamber 54 which is of a known type. The primers feed in consecutive order down a covered trough 52 under the influence of gravity. A chamber 100 and a swinging arm 53 mounted on the chamber, are depicted in FIG. 14. The chamber assembly has a tubular extension 101 which has a side wall slot 102. Cylindrical extension 101 registers in a cylindrical sleeve 103 that is cast integrally with the conical shell plate carrier 29. The previously mentioned primer setting lever 49 is mounted to the shell plate carrier for pivoting as shown in FIG. 11. When lever 49 pivots, a cylindrical element 104 (FIG. 14) that is formed at the end of the lever 49 swings upwardly and provides the force for driving a primer into the shell which is presently aligned with station 35 on the tool holder 25 in FIG. 1. As is evident in FIG. 2, when the ram 14 is raised to near its upper limit, the outboard end of lever 49 strikes a stop bolt 105 which is adjustably mounted to the reloader frame. When lever 49 is rocked due to the interference of the bolt 105, the primer is driven into the shell. Within the conical shell plate carrier 29 shown in FIG. 14 there is a hollow cylindrical member 106 that is open on its bottom, not shown. There is a spring, not visible, in cylindrical member 106 that biases the outboard end of lever 49 upwardly and the inner end 104 downwardly. The spring 119 appears in FIG. 11. Of course, when the outboard end of lever 49 strikes stop bolt 105 the outboard end of the lever moves down and the inboard end of the lever moves up to drive a primer into the shell.

The pin that actually drives a small primer into a shell is marked 107 in the exploded view. It is on a plunger 108 that has a side opening 120 in which the cylindrical end 104 of lever 49 registers in plunger 108. A compression spring 110 stands next to primer drive pin 107. It develops a reactive force between the plunger 108 and the flat top region 111 of chamber 100. Spring 110 assures that plunger 108 will not bind in the bore of cylinder 103 when the plunger 108 is being driven.

The swinging arm 53 shown in FIG. 14 swings on stud shaft 112 which passes through an eye portion 113 formed integrally with the molded plastic housing 100. A pin 121 extends upwardly from housing portion 111 and through a tongue portion 114 on the end of arm 53. Tongue 114 has a hole through which the pin 113 extends. A slot 115 in the top of chamber portion 111 provides for allowing the arm 53 to push pin 121 laterally. In FIG. 14, arm 53 is in a reset position wherein it can permit a primer coming down the trough 52 to be prepositioned for insertion in a shell.

Plastic arm 53 is formed with a substantially semicircular wiper 116 on it. When the ram is at its lowermost position where indexing of the shell plate 30 takes place, and if there is a shell in the appropriate shell holder pocket of the shell plate, that shell will strike springy curved wiper 116 for driving arm 53 to the reset position in which it resides in FIG. 14.

Within chamber portion 111 there is a reciprocal slider 117 from which pin 121 extends upwardly. Reciprocal slider 117 has a side slot into which a primer is accepted and is positioned just about in alignment with the hole 118 in the top of chamber portion 111. The shell on the shell plate has the usual cavity for accommodating a primer aligned with the hole 118. When pin 107 is driven upwardly, the primer is set in the shell that is in the shell plate above hole 118.

Figure 12:
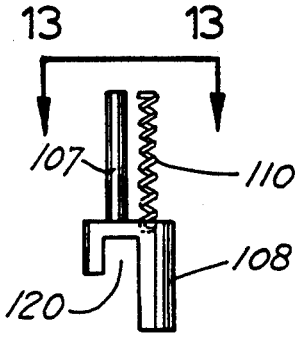
FIG. 12 is a side elevational view of the drive pin assembly of the primer inserter as viewed in the direction of the arrows 12—12 in FIG. 11.
Figure 13:
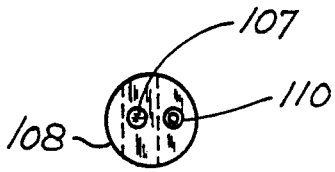
FIG. 13 is a top view of the drive pin assembly as viewed in the direction of the arrows 13—13 in FIG. 12.

FIG. 11 provides a more detailed view as to how rocking lever 49 is mounted in the carrier 29. In this view, the spring which was previously mentioned as being in inverted hollow cylinder 106 is given the reference numeral 119. The plunger 108 that slides in the bore of cylinder 103 is shown in profile in FIG. 12 and in a plan view in FIG. 13. In FIG. 12 one may see how the return spring 110 relates to primer drive pin 107. Note the notch 120 in the side of plunger 108. This is to accommodate the inboard end of rocking lever 49.

Figure 15:
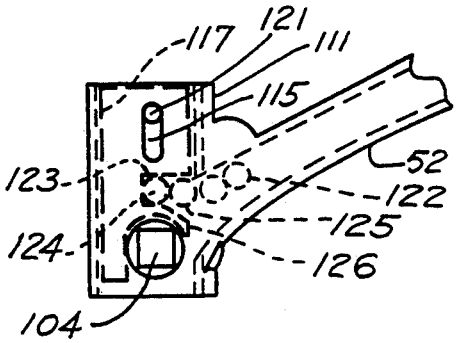
FIG. 15 shows a part of the primer inserter and a fragment of the trough by which live primers are fed to the inserter.

FIG. 15 shows some of the primers 122 that have descended by gravity in the trough 52 as shown. When the ram descends the trough 52 encounters protuberances 59 on the frame leg 12 in FIG. 1. This agitates the primers in round tray 51 to thereby keep the trough filled with primers.

Reciprocating slider 117 in FIG. 15 has a side notch 123. Adjacent the notch there is a formed curved portion 126. The curved portion prohibits primers from entering the opening wherein the inboard end of rocking lever 104 can drive the driving element 108 upwardly to insert the primer into the shell. When the reciprocating slider 117 is retracted as in FIG. 15, one primer 124 is in the proper position for being delivered to the point where it is pressed from below into the shell. When the reciprocating slider 117 is retracted again, the next available primer 125 will reside in notch 123 in place of primer 124.

The operating mode of the primer inserter is as follows: first of all, note that a primer arm actuator pin 130 is fixedly mounted to the frame 10 of the reloader. Actuator pin 130 has a tapered lower end and is also depicted in FIG. 14. Swinging arm 53 has a bevelled camming surface 131. When the ram is elevated, carrying the arm 53 with it, tapered actuator pin 130 is struck by camming surface 131 to cause the arm 53 to swing in a counter-clockwise direction as viewed in FIG. 14. The swinging of the arm 53 drives the reciprocating slider 117 into the position wherein it sets up a primer for the primer to be driven into a shell. Very near the end of the uppermost position of the ram and shell plate thereon, the outboard end of rocking lever 49 runs up against stationary adjustable stop bolt 105 which rocks the lever 49 and drives a primer into the shell. The arm 53 stays in its counter-clockwise rotated position until the ram descends to within a few millimeters of its lower limit at which time the shell plate 30 is indexed as previously described. Then if there is a shell in the shell plate that can strike the curved springy part 116 on swinging arm 53, the arm is reset or swung back to its FIG. 14 position.

Figure 16:
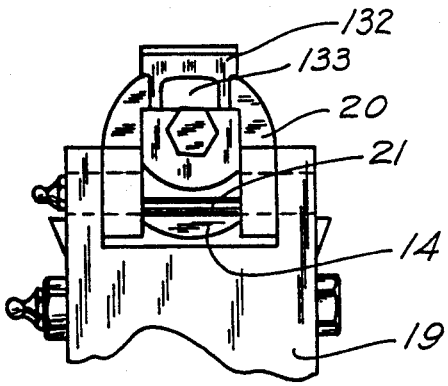
FIG. 16 is a bottom plan view of the ram of the reloader showing the lower end of the manual operating lever and an openable sliding door for accessing spent primers that drop into the hollow ram, this view being taken in the direction of the arrows 16—16 in FIG. 2.

When primers are expelled from the shells they drop through conical shell carrier 29 and fall to the bottom of ram 14. As shown in FIG. 16, there is a slidable door 132 in the bottom of the ram 14. Sliding door 132 is presently in its open position to clear an opening 133 through which spent primers can fall out for being caught in an appropriate container.

Although the improved shell reloader has been described in considerable detail, such description is intended to be illustrative rather than limiting, for the invention may be variously embodied and is to be limited only by interpretation of the claims which follow.

I claim:

1. An ammunition case reloader comprising:

a frame, a member on the frame for supporting a plurality of reloading tools at angularly spaced apart stations, a ram mounted to said frame for moving alternately upwardly toward said tools and downwardly away from said tools, a shell plate carrier mounted to the ram and a shell plate mounted to the carrier for being indexed rotationally in angular steps, an operating lever mounted for swinging alternately downwardly and upwardly, and means for operatively coupling the lever to the ram such that swinging the lever downwardly moves the ram upwardly to an uppermost position wherein a case on said shell plate engages a tool and swinging the lever upwardly moves the ram and the shell plate thereon downwardly to a lowermost position for the shell plate to move downwardly through an indexing position after the ram moves through more than a majority of the distance from its said uppermost to its said lowermost position, a shell plate indexer member supported from the ram for being driven in one direction to engage the shell plate and turn it through one angular step under the influence of said lever when the lever has swung upwardly far enough to move said shell plate downwardly to said indexing position, and means for retracting said indexer member oppositely from said one direction to a reset condition in response to said ram moving to said uppermost position under the influence of said lever moving downwardly.

2. The reloader according to claim 1 wherein:

a plurality of indexer member engageable elements project downwardly from said shell plate toward said shell plate carrier and said elements are arranged in spaced apart relationship in angular correspondence with said tools for being engaged by the indexer member, said indexer member comprising a rod member supported from said ram and slidable into engagement with said elements on the shell plate in succession to index said shell plate through successive angular steps.

3. The reloader according to claim 1 wherein:

a plurality of cylindrical indexer engageable elements project downwardly from said shell plate toward said shell plate carrier and said elements are arranged in spaced apart relationship in angular correspondence with said tools for being engaged by the indexer member, said indexer member comprising a rod member mounted to said shell plate carrier for sliding radially inwardly to engage an element for turing said shell plate one angular step and for sliding outwardly under the influence of said means for retracting said indexer member.

4. The reloader according to claim 1 wherein:

a plurality of cylindrical indexer engaging elements project downwardly from said shell plate and said elements are arranged angularly spaced apart from each other in angular correspondence with said tools, said indexer is comprised of a rod member having a quadrilateral cross section and a beveled end.

5. The reloader according to any one of claims 1, 2, 3 or 4 including:

retractor means fixedly mounted on said frame for engaging said indexer to retract it and reset it for being driven in said one direction when said indexer is moving downwardly with said ram.

6. The reloader according to any one of claims 1, 2, 3 or 4 wherein said indexer is driven in said one direction to index said shell plate when said ram is about 6 to 3 mm from said lowermost position.

7. The reloader according to claim 1 wherein one of the tools is a tool for expelling the spent primer from a shell in response to the shell in the shell plate moving upwardly into the tool, said ram being hollow and having a passageway for receiving the expelled primer, and said ram having a door operable to discharge the spent primer.

8. The reloader according to any one of claims 1, 2, 3 or 4 including a shell inserter for inserting shells in succession in correspondence with indexing steps of the shell plate, comprising:

a slide guide supported from said ram, a shell inserter slider mounted on said slide guide for advancing toward and retracting from said shell plate, said shell inserter slider being configured at an end presented toward said shell plate for receiving and releasing a shell into a shell holder pocket in the shell plate, in response to advancement of the shell slider, a guide shaft fixedly mounted to said frame and projecting generally upwardly at an angle relative to vertical, a crank slider mounted on the angulated guide shaft for sliding generally upwardly and downwardly thereon, a crank pivotally connected to said crank slider and to the shell inserter slider, said crank slider being sufficiently frictionally engaged with said guide shaft for said crank slider to be slightly retarded such that when the ram starts from its lower limit to move upwardly said slider remains temporarily substantially stationary on the guide shaft for causing said crank to swing under the influence of the force of the moving ram and to urge said shell inserter slider to said shell plate for inserting a shell in a shell holder pocket.

9. An ammunition case reloader comprising:

a frame, a plurality of tools mounted to said frame at angularly spaced apart stations, a ram mounted to said frame for moving upwardly to said tools and downwardly to a lower position, a shell plate carrier mounted to said ram and a shell plate mounted for being indexed in rotationally angular steps on said carrier, said shell plate having a plurality of case holder pockets spaced apart in angular correspondence with said tools, an operating lever operatively coupled to said ram for moving the ram to an upper position for said tools to operate on cases in said shell plate and for moving said ram downwardly to said lower position, a shell plate rotationally indexable an angular step for a cycle of upward and downward movement of the ram, a slide guide supported from said ram, a case inserter slider mounted on said slide guide for advancing toward and retracting from said shell plate, said case inserter slider is configured at an end presented toward said shell plate for receiving a case and releasing a case into a case holder pocket in the shell plate in response to advancement of the case inserter slider, a guide shaft fixedly mounted to said frame and projecting generally upwardly at an angle relative to vertical, a crank slider mounted on the guide shaft for sliding at an angle relative to vertical generally upwardly and downwardly thereon, a crank pivotally connected to said crank slider and to the case inserter slider, said crank slider moving on said guide shaft such that when the ram starts to move upwardly from its lower position frictional retardation of aid crank slider causes said crank to swing under the influence of the moving ram and to urge said case inserter slider to said shell plate for inserting a case in said case holder pocket.

10. The reloader according to any one of claims 1 or 9 including a device for inserting a primer in a case after the spent primer of the case has been removed and the shell plate has been indexed to thereby position the case after the spent primer of the case has been removed and the shell plate has been indexed to thereby position the case at the primer insertion station, comprising:

a housing including a chamber and a trough coupled to the chamber through which primers are fed by gravity to the chamber, a reciprocating slider in the chamber having a notch for receiving a primer, said slider adapted for reciprocating to a retracted position for receiving a primer in the notch and to an advanced position for releasing the primer, a swingable arm pivotally supported from the housing and means for coupling the arm to the reciprocating slider, a stationary arm actuator mounted to the frame of the reloader and arranged for engaging said arm to swing and advance said reciprocating slider to slide a primer into a position of readiness for being inserted in a case when said ram is moving toward its uppermost position, a rocking lever pivotally mounted to said shell plate carrier, the lever having a first end portion for driving a primer and a second end portion, a cylindrical member for coupling said chamber to said shell plate carrier and a plunder having an upwardly extending primer setting pin, said plunger positioned over said second end portion of the rocking lever, a stop member mounted to said reloader frame in a position for acting on said first end portion in response to said ram moving upwardly for actuating said plunger and the setting pin to drive a primer into a shell, said swinging arm being constructed and arranged for being swung in a direction for retracting and reciprocating slider by being impacted by a case in the shell plate that is moving due to indexing of the shell plate when said ram is lowered to near its lower limit.

11. An ammunition case reloader comprising:

a frame, a member on the frame for supporting a plurality of reloading tools at angularly spaced apart stations, a ram mounted to said frame for moving upwardly to said tools and alternately downwardly and manually operated means for moving said ram upwardly and downwardly, a shell plate mounted to said ram for being indexed in rotationally angular steps, said shell plate having a plurality of case holder pockets spaced apart in angular correspondence with said tools, means for indexing said shell plate one angular step in response to said ram moving downwardly, a case inserter device for inserting cases in succession into said pockets of the shell plate in correspondence with indexing steps of the shell plate the inserter device including, a slide guide fixedly supported from the ram and extending radially of said shell plate, a case inserter slide mounted on said slider guide for retracting to provide a clear region on the slide guide for a case inserter slider and the shell plate, and for advancing to insert the case in a pocket of the shell plate, a guide shaft fixedly mounted to said frame and projecting upwardly at an angle away from said ram relative to vertical, a crank slider mounted on the guide shaft for sliding upwardly and downwardly thereon, a crank pivotally connected to said case inserter slider and to said crank slider, said crank slider having a predetermined amount of frictional retardation relative to said guide shaft, said crank being constructed and arranged such that when said ram approaches its uppermost position and said crank slider is shifted at an angle on said guide shaft away from the ram, said crank slider causes said shell inserter slider to retract to provide for depositing said shell on the slide guide, lowering of said ram and the case inserter slider thereon and simultaneous lowering of said crank slider causing said crank to turn in one direction to keep said shell case inserter slider retracted from the shell plate to prevent the case from being inserted in a shell plate pocket, raising said ram a short distance above said lower limit while the friction between said crank slider is not yet overcome so the slider does not move on said guide shaft for a short interval causing said crank to turn oppositely of said one direction to advance said case inserter slider to insert the case in a pocket of said shell plate.

12. An ammunition case reloader comprising:

a frame, a member on the frame for supporting a plurality of reloading tools at angularly spaced apart stations, a ram mounted to said frame for moving alternately upwardly to said tools and downwardly from said tools, a shell plate carrier mounted to said ram and a generally circular shell plate mounted to the carrier for being indexed in rotationally angular steps, said shell plate having a plurality of case holder pockets in its periphery spaced apart in angular correspondence with said tools and having a plurality of indexer engageable elements equiangularly spaced apart and projecting downwardly from the shell plate in the carrier, an operating lever mounted on said frame for being swung downwardly and upwardly to an upper limit and means for operatively coupling said lever to said ram such that swinging the lever downwardly moves said ram to an uppermost position wherein a case on said shell plate engages a tool and swinging the lever upwardly moves and index plate thereon said ram downwardly to a, lowermost position for the shell plate to move downwardly through an indexing position after said ram moves through more than a majority of the distance from its uppermost to its lowermost position, a shell plate indexer rod mounted on said shell plate carrier for being driven inwardly of said carrier by said operating lever when the lever is swung upwardly to drive the rod against an indexer engageable element on the shell plate and thereby turn the shell plate one angular step when said ram is moving downwardly and has passed through a majority of the distance between said uppermost and lowermost positions, said indexer rod having mounted on it a lower flipper and said frame having a generally downwardly extending track on it such that when said ram is driven to its position by swinging said operating lever downwardly for cases on the shell plate to engage said tools, said follower flipper is engaged with said track as said ram and follower flipper move downwardly in response to said operating lever moving upwardly, said track being configured to cause said indexer rod to retract from engagement with an indexer engageable element on said shell plate, continued swinging of said operating lever upwardly for moving said ram downwardly to said indexing position resulting in said lever driving said indexer rod into engagement with an indexer engageable element to rotate said shell plate one angular step.

13. The reloader, according to claim 12, including a projection on said frame arranged for being struck by the descending flipper immediately before said ram reaches said lowermost position to swing said indexer rod into direct alignment with an indexer engageable element before the operating lever begins to drive the indexer rod.

14. The reloader, according to claim 13, including guide elements in said shell plate carrier arranged to guide said indexer rod into alignment with an indexer engageable element.

15. The reloader according to any one of claims 12, 13, or 14 including a stop element (75) in said shell plate carrier in the path of movement of the indexer rod, said indexer rod having a level at one end thereof for jamming against said stop element when said indexer rod is driven in far enough by said operating lever to complete a shell plate indexing step.

* * * * *